US011527127B2

(12) United States Patent
Walsh et al.

(10) Patent No.: US 11,527,127 B2
(45) Date of Patent: Dec. 13, 2022

(54) SYSTEMS AND METHODS OF ELECTRONIC GAMING INCLUDING JIGSAW REELS

(71) Applicant: ARISTOCRAT TECHNOLOGIES AUSTRALIA PTY LIMITED, North Ryde (AU)

(72) Inventors: Kevin Raymond Walsh, Reno, NV (US); Eric Fiedler Taylor, Carson City, NV (US)

(73) Assignee: Aristocrat Technologies Australia Pty Limited

( * ) Notice: Subject to any disclaimer, the term of this patent is extended or adjusted under 35 U.S.C. 154(b) by 71 days.

(21) Appl. No.: 16/050,903

(22) Filed: Jul. 31, 2018

(65) Prior Publication Data

US 2020/0043280 A1 Feb. 6, 2020

(51) Int. Cl.
*G07F 17/32* (2006.01)

(52) U.S. Cl.
CPC ..... *G07F 17/3213* (2013.01); *G07F 17/326* (2013.01); *G07F 17/3286* (2013.01)

(58) Field of Classification Search
CPC ..... G07F 17/3213; G07F 17/326; G07F 17/3286; G07F 17/34; G07F 17/3244; A63F 13/00; A63F 13/10; A63F 13/45; A63F 9/10
See application file for complete search history.

(56) References Cited

U.S. PATENT DOCUMENTS 5,833,537 A * 11/1998 Barrie ..... G07F 17/3265 463/21
6,095,921 A * 8/2000 Walker ..... G07F 17/32 273/138.2
8,128,481 B2 * 3/2012 Yoshizawa ..... G07F 17/32 463/20
2003/0181239 A1 9/2003 Walker et al.
2004/0176156 A1 * 9/2004 Walker ..... G07F 17/32 463/16
2004/0201169 A1 * 10/2004 Schaefer ..... A63F 3/0665 273/139
2004/0204229 A1 * 10/2004 Walker ..... G07F 17/32 463/20
2005/0059460 A1 3/2005 Breen et al.
2006/0003832 A1 * 1/2006 Mincey ..... G07F 17/32 463/25

(Continued)

*Primary Examiner* — William H McCulloch, Jr.
*Assistant Examiner* — Ankit B Doshi
(74) *Attorney, Agent, or Firm* — Armstrong Teasdale LLP

(57) ABSTRACT

An electronic gaming machine includes a game controller that executes instructions that cause the game controller to at least: (i) display, on a display, a plurality of reels, each reel of the plurality of reels comprising a plurality of symbols, each symbol representing a puzzle piece including a plurality of connectors; (ii) simulate spinning and stopping each reel of the first plurality of reels, whereby symbols from each reel of the first plurality of reels are stopped and displayed; (iii) evaluate the plurality of symbols displayed on of the plurality of reels; (iv) determine, in response to the evaluating, which of the displayed symbols match with adjacent symbols, wherein matching an adjacent symbol includes interconnecting between adjacent connectors on adjacent symbols; and (v) provide a game award in response to the determining.

20 Claims, 8 Drawing Sheets

(56) References Cited

U.S. PATENT DOCUMENTS

| | | | | |
|---|---|---|---|---|
| 2006/0252500 | A1* | 11/2006 | Han | G07F 17/34 463/25 |
| 2008/0113735 | A1 | 5/2008 | Maya | |
| 2009/0221352 | A1 | 9/2009 | Nakano | |
| 2011/0269518 | A1 | 11/2011 | Carbonaro et al. | |
| 2013/0017881 | A1 | 1/2013 | Watkins | |
| 2013/0331167 | A1* | 12/2013 | Meistrich | G07F 17/34 463/20 |
| 2015/0170462 | A1 | 6/2015 | Berman et al. | |
| 2015/0363999 | A1 | 12/2015 | Little et al. | |
| 2016/0078710 | A1 | 3/2016 | Pierer et al. | |
| 2016/0364948 | A1 | 12/2016 | Parviainen et al. | |
| 2017/0228982 | A1* | 8/2017 | Caputo | G07F 17/326 |
| 2017/0282055 | A1 | 10/2017 | McKevitt et al. | |

* cited by examiner

SYSTEMS AND METHODS OF ELECTRONIC GAMING INCLUDING JIGSAW REELS

TECHNICAL FIELD

The field of disclosure relates generally to electronic gaming, and more particularly, to systems and methods of electronic gaming using a plurality of reels where the symbols on the reels are puzzle pieces and where the player is awarded based on interlocking adjacent puzzle pieces.

BACKGROUND

Electronic gaming machines (EGMs), or gaming devices, provide a variety of wagering games such as, for example, and without limitation, slot games, video poker games, video blackjack games, roulette games, video bingo games, keno games, and other types of games that are frequently offered at casinos and other locations. Play on EGMs typically involves a player establishing a credit balance by inserting or otherwise submitting money and placing a monetary wager (deducted from the credit balance) on one or more outcomes of an instance, or play, of a primary game, sometimes referred to as a base game. In many games, a player may qualify for secondary games or bonus rounds by attaining a certain winning combination or other triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

Slot games are often displayed to the player in the form of various symbols arranged in a row-by-column grid, or "matrix," which may define a plurality of symbol positions, and which may be generated by spinning a plurality of reels, each of which may correspond to a respective symbol position or column of the matrix. Specific matching combinations of symbols along predetermined paths, or paylines, drawn through the matrix indicate the outcome of the game. The display typically highlights winning combinations and outcomes for ready identification by the player. Matching combinations and their corresponding awards are usually shown in a "pay-table" that is available to the player for reference. Often, the player may vary his/her wager to included differing numbers of paylines and/or the amount bet on each line. By varying the wager, the player may sometimes alter the frequency or number of winning combinations, the frequency or number of secondary games, and/or the amount awarded.

Typical games use a random number generator (RNG) to randomly determine the outcome of each game. The game is designed to return a certain percentage of the amount wagered back to the player, referred to as return to player (RTP), over the course of many plays or instances of the game. The RTP and randomness of the RNG are fundamental to ensuring the fairness of the games and are therefore highly regulated. The RNG may be used to randomly determine the outcome of a game and symbols may then be selected that correspond to that outcome. Alternatively, the RNG may be used to randomly select the symbols whose resulting combinations determine the outcome. Notably, some games may include an element of skill on the part of the player and are therefore not entirely random.

As described above, many EGMs are configured to display a plurality of reels, each of which may be spun and stopped, to display a plurality of symbols in a matrix of symbol positions. The symbols stopped and displayed from each reel may be evaluated, such as by a computer processor, to determine whether any combination of symbols appearing in the matrix corresponds to a game award. Such known games use matching symbols or patterns rather than how the shapes of the symbols interact.

BRIEF DESCRIPTION

In one aspect, an electronic gaming machine is provided. The electronic gaming machine includes a display, a player input interface configured to receive a player input, a credit input mechanism including at least one of a card reader, a ticket reader, a bill validator, and a coin input mechanism, wherein the credit input mechanism is configured for receiving a credit balance, and a game controller configured to execute instructions stored in a tangible, non-transitory, computer-readable storage medium, which, when executed by the game controller, cause the game controller to at least: (i) display, on the display, a plurality of reels, each reel of the plurality of reels comprising a plurality of symbols, each symbol representing a puzzle piece including a plurality of connectors; (ii) simulate spinning and stopping each reel of the plurality of reels, whereby symbols from each reel of the plurality of reels are stopped and displayed; (iii) evaluate the plurality of symbols displayed on the plurality of reels; (iv) determine, in response to the evaluating, which of the displayed symbols match with adjacent symbols, wherein matching an adjacent symbol includes interconnecting between adjacent connectors on adjacent symbols; and (v) provide a game award in response to the determining.

In another aspect, a method for specifying a player goal to be achieved during play of a wagering game on an electronic gaming machine is provided. The electronic gaming machine includes a display configured to present the wagering game, a player input interface, a game controller, and a credit input mechanism including at least one of a card reader, a ticket reader, a bill validator, and a coin input mechanism. The method includes: (i) displaying, on the display, a plurality of reels, each reel of the plurality of reels comprising a plurality of symbols, each symbol representing a puzzle piece including a plurality of connectors; (ii) simulating spinning and stopping each reel of the plurality of reels, whereby symbols from each reel of the plurality of reels are stopped and displayed; (iii) evaluating the plurality of symbols displayed on of the plurality of reels; (iv) determining, in response to the evaluating, which of the displayed symbols match with adjacent symbols, wherein matching an adjacent symbol includes interconnecting between adjacent connectors on adjacent symbols; and (v) providing a game award in response to the determining.

In yet another aspect, a computer-readable storage medium is provided. The computer-readable storage medium includes computer-executable instructions embodied thereon, which when executed by a game controller of an electronic gaming machine, cause the game controller to at least: (i) display, on a display, a plurality of reels, each reel of the plurality of reels comprising a plurality of symbols, each symbol representing a puzzle piece including a plurality of connectors; (ii) simulate spinning and stopping each reel of the plurality of reels, whereby symbols from each reel of the plurality of reels are stopped and displayed; (iii) evaluate the plurality of symbols displayed on of the plurality of reels; (iv) determine, in response to the evaluating, which of the displayed symbols match with adjacent symbols, wherein matching an adjacent symbol includes interconnecting between adjacent connectors on adjacent symbols; and (v) provide a game award in response to the determining.

BRIEF DESCRIPTION OF THE DRAWINGS

An example embodiment of the subject matter disclosed will now be described with reference to the accompanying drawings.

DETAILED DESCRIPTION

The wagering game described herein may include one or more sets of reels. In the exemplary embodiment, each reel includes a plurality of positions where symbols may be placed. Each symbol resembles a puzzle piece (such as a jigsaw puzzle piece). The reels may be spun and stopped, and the plurality of symbols from each of the reels may be displayed. The symbols from each reel may be evaluated to determine whether adjacent symbols are puzzle pieces that may fit together or interlock. The player is rewarded based on how the puzzle pieces fit together, how many puzzle pieces have connections, and/or how many connections are made for each puzzle piece. In some embodiments, if a predetermined number of puzzle pieces match, a bonus game is initiated. The bonus game keeps the matched pieces/symbols and provides a number of free spins for the player to make additional matches. In some further embodiments, if all of the symbols are matched the puzzle changes orientation to reveal an image. In other words, if and when the puzzle pieces complete an entire puzzle, the puzzle pieces flip over to reveal an image on the other side that is formed by the puzzle pieces. The exposed image may relate to an additional award to the player.

Figure 1:
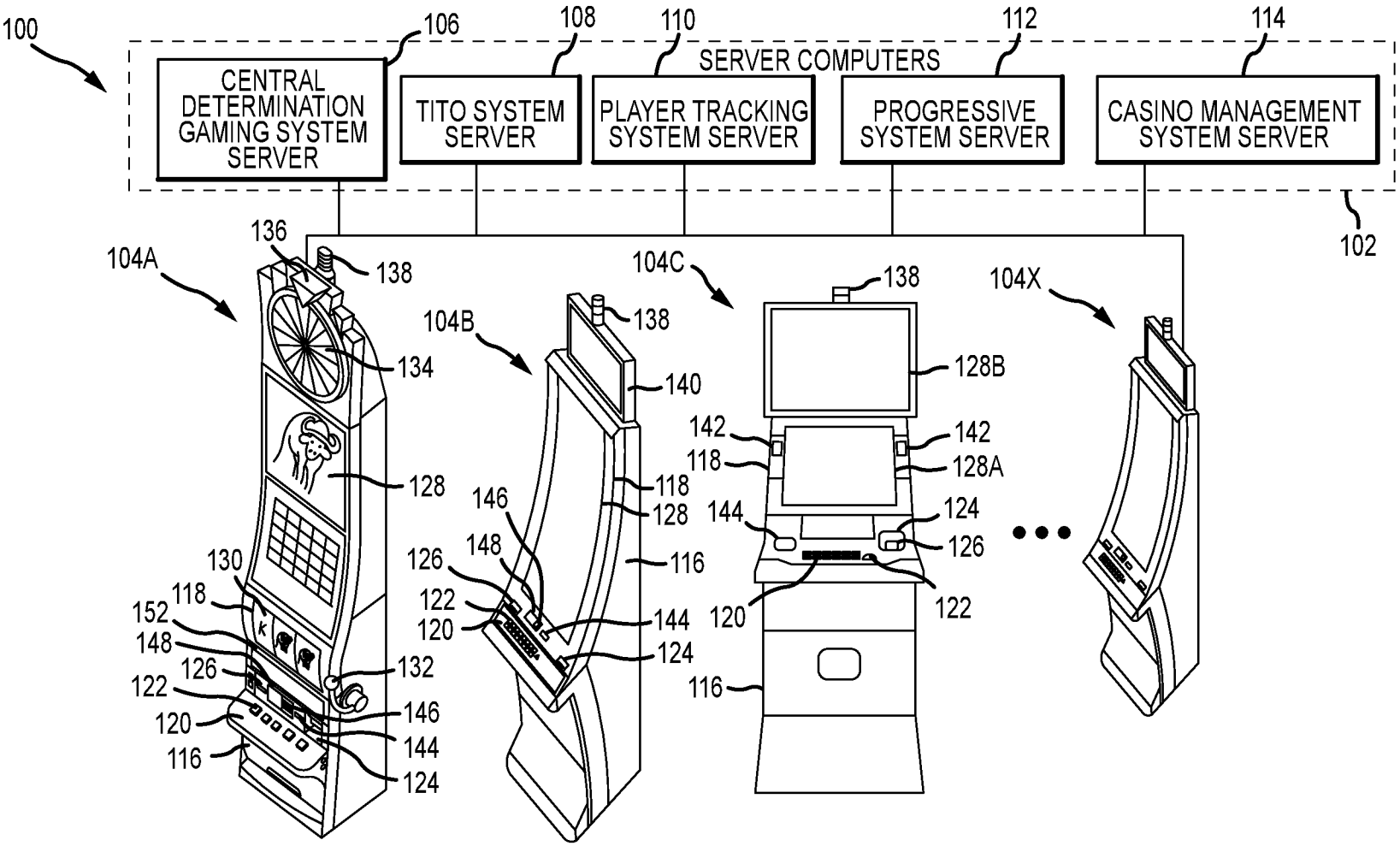
FIG. 1 is a diagram of exemplary EGMs networked with various gaming-related servers.

FIG. 1 is a diagram of exemplary EGMs networked with various gaming-related servers in a gaming system 100. Gaming system 100 operates in a gaming environment, including one or more servers, or server computers, such as slot servers of a casino, that are in communication, via a communications network, with one or more EGMs, or gaming devices 104A-104X, such as EGMs, slot machines, video poker machines, or bingo machines, for example. Gaming devices 104A-104X may, in the alternative, be portable and/or remote gaming devices such as, for example, and without limitation, a smart phone, a tablet, a laptop, or a game console.

Communication between gaming devices 104A-104X and servers 102, and among gaming devices 104A-104X, may be direct or indirect, such as over the Internet through a web site maintained by a computer on a remote server or over an online data network including commercial online service providers, Internet service providers, private networks, and the like. In other embodiments, gaming devices 104A-104X communicate with one another and/or servers 102 over wired or wireless RF or satellite connections and the like.

In certain embodiments, servers 102 may not be necessary and/or preferred. For example, the present invention may, in one or more embodiments, be practiced on a stand-alone gaming device such as gaming device 104A and/or gaming device 104A in communication with only one or more other gaming devices 104B-104X (i.e., without servers 102).

Servers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, a game outcome may be generated on a central determination gaming system server 106 and then transmitted over the network to any of a group of remote terminals or remote gaming devices 104A-104X that utilize the game outcome and display the result to the player.

Gaming device 104A is often of a cabinet construction that may be aligned in rows or banks of similar devices for placement and operation on a casino floor. The gaming device 104A often includes a main door 117 that provides access to the interior of the cabinet. Gaming device 104A typically includes a button area or button deck 120 accessible by a player that is configured with input switches or buttons 122, a bill validator 124, and/or ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 including a plurality of mechanical reels 130, typically 3 or 5 mechanical reels, with various symbols displayed there on. Reels 130 are then independently spun and stopped to show a set of symbols within the gaming display area 118 that may be used to determine an outcome to the game.

In many configurations, gaming machine 104A may have a main display 128 (e.g., video display monitor) mounted to, or above, gaming display area 118. Main display 128 may be, for example, a high-resolution LCD, plasma, LED, or OLED panel that may be flat or curved as shown, a cathode ray tube, or other conventional electronically controlled video monitor.

In certain embodiments, bill validator 124 may also function as a "ticket-in" reader that enables the player to use a casino-issued credit ticket to load credits onto gaming device 104A (e.g., in a cashless TITO system). In such cashless embodiments, gaming device 104A may also include a "ticket-out" printer 126 for outputting a credit ticket when a "cash out" button is pressed. Cashless ticket systems are well known in the art and are used to generate and track unique bar-codes printed on tickets to allow players to avoid the use of bills and coins by loading credits using a ticket reader and cashing out credits using ticket-out printer 126 on gaming device 104A.

In certain embodiments, a player tracking card reader 144, a transceiver for wireless communication with a player's smartphone, a keypad 146, and/or an illuminated display 148 for reading, receiving, entering, and/or displaying player tracking information can be provided. In such embodiments, a game controller within gaming device 104A communicates with player tracking server system 110 to send and receive player tracking information.

Gaming device 104A may also include, in certain embodiments, a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but could also be incorporated into play of the base game, or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

In certain embodiments, there may also be one or more information panels 152 that may be, for example, a back-lit silkscreened glass panel with lettering to indicate general game information including, for example, a game denomination (e.g., $0.25 or $1), pay lines, pay tables, and/or various game related graphics. In some embodiments, information panels 152 may be implemented as an additional video display.

Gaming device 104A traditionally includes a handle 132 typically mounted to the side of main cabinet 116 that may be used to initiate game play.

Figure 2:
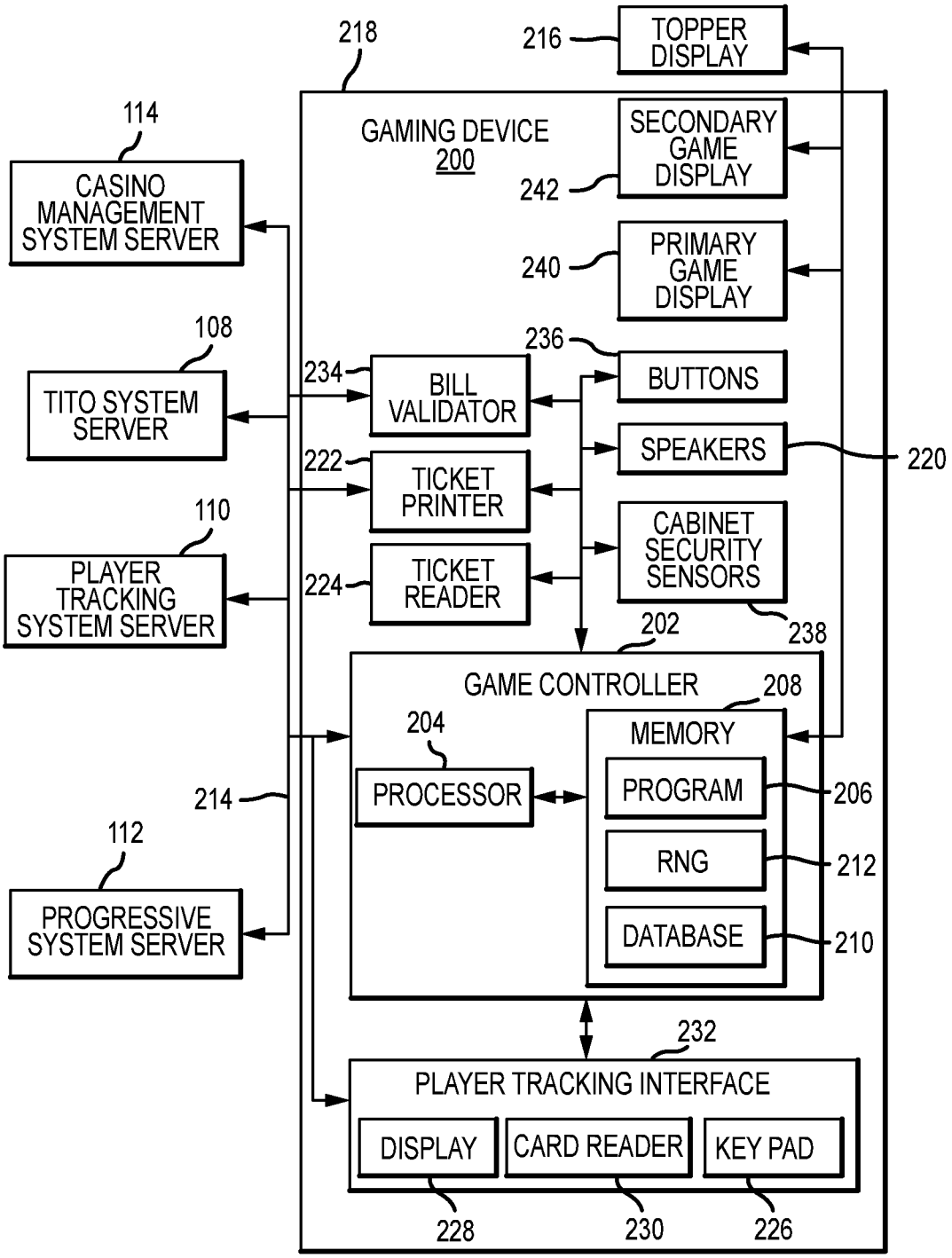
FIG. 2 is a block diagram of an exemplary EGM.

Many or all of the above described components may be controlled by circuitry (e.g., a gaming controller) housed inside main cabinet 116 of gaming device 104A, the details of which are shown in FIG. 2.

Not all gaming devices suitable for implementing embodiments of the gaming systems, gaming devices, or methods described herein necessarily include top wheels, top boxes, information panels, cashless ticket systems, and/or player tracking systems. Further, some suitable gaming devices have only a single game display that includes only a mechanical set of reels and/or a video display, while others are designed, for example, for bar tables or table tops and have displays that face upwards.

Exemplary gaming device 104B shown in FIG. 1 is an Arc™ model gaming device manufactured by Aristocrat® Technologies, Inc. Where possible, reference numeral identifying similar features of gaming device 104A are also identified in gaming device 104B using the same reference numerals. Gaming device 104B, however, does not include physical reels 130 and instead shows game play and related game play functions on main display 128. An optional topper screen 140 may be included as a secondary game display for bonus play, to show game features or attraction activities while the game is not in play, or any other information or media desired by the game designer or operator. In some embodiments, topper screen 140 may also or alternatively be used to display progressive jackpot prizes available to a player during play of gaming device 104B.

Gaming device 104B includes main cabinet 116 having main door 117 that opens to provide access to the interior of gaming device 104B. Main door 117, or service door, is typically used by service personnel to refill ticket-out printer 126 and collect bills and tickets inserted into bill validator 124. Main door 117 may further be accessed to reset the machine, verify and/or upgrade the software, and for general maintenance operations.

Exemplary gaming device 104C shown in FIG. 1 is a Helix™ model gaming device manufactured by Aristocrat® Technologies, Inc. Gaming device 104C includes a main display 128A that is in a landscape orientation. Although not illustrated by the front view illustrated in FIG. 1, landscape display 128A may include a curvature radius from top to bottom. In certain embodiments, display 128A is a flat panel display. Main display 128A is typically used for primary game play while a secondary display 128B is used for bonus game play, to show game features or attraction activities while the game is not in play, or any other information or media desired by the game designer or operator.

Many different types of games, including mechanical slot games, video slot games, video poker, video black jack, video pachinko, keno, bingo, and lottery, may be provided with or implemented within gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, Class II, or Class III, etc.

FIG. 2 is a block diagram of an exemplary gaming device 200, or EGM, connected to various external systems, including TITO system server 108, player tracking system server 110, progressive system server 112, and casino management system server 114. All or parts of gaming device 200 may be embodied in game devices 104A-104X shown in FIG. 1. The games conducted on gaming device 200 are controlled by a game controller 202 that includes one or more processors 204 and a memory 208 coupled thereto. Games are represented by game software or a game program 206 stored on memory 208. Memory 208 includes one or more mass storage devices or media housed within gaming device 200. One or more databases 210 may be included in memory 208 for use by game program 206. A random number generator (RNG) 212 is implemented in hardware and/or software and is used, in certain embodiments, to generate random numbers for use in operation of gaming device 200 to conduct game play and to ensure the game play outcomes are random and meet regulations for a game of chance.

Alternatively, a game instance, or round of play of the game, may be generated on a remote gaming device such as central determination gaming system server 106, shown in FIG. 1. The game instance is communicated to gaming device 200 via a network 214 and is then displayed on gaming device 200. Gaming device 200 executes game software to enable the game to be displayed on gaming device 200. In certain embodiments, game controller 202 executes video streaming software that enables the game to be displayed on gaming device 200. Game software may be loaded from memory 208, including, for example, a read only memory (ROM), or from central determination gaming system server 106 into memory 208. Memory 208 includes at least one section of ROM, random access memory (RAM), or other form of storage media that stores instructions for execution by processor 204.

Gaming device 200 includes a topper display 216. In an alternative embodiment, gaming device 200 includes another form of a top box such as, for example, a topper wheel, or other topper display that sits on top of main cabinet 218. Main cabinet 218 or topper display 216 may also house various other components that may be used to add features to a game being played on gaming device 200, including speakers 220, a ticket printer 222 that prints bar-coded tickets, a ticket reader 224 that reads bar-coded tickets, and a player tracking interface 232*a*. Player tracking interface 232*a* may include a keypad 226 for entering player tracking information, a player tracking display 228 for displaying player tracking information (e.g., an illuminated or video display), a card reader 230 for receiving data and/or communicating information to and from media or a device such as a smart phone enabling player tracking. Ticket printer 222 may be used to print tickets for TITO system server 108. Gaming device 200 may further include a bill validator 234, buttons 236 for player input, cabinet security sensors 238 to detect unauthorized opening of main cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g., amount wagered and time of play) for individual players so that an operator may reward players in a loyalty program. The player may use player tracking interface 232*a* to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game wagering at a given casino). Player tracking rewards may be complimentary and/or discounted meals, lodging, entertainment and/or additional play. Player tracking information may be combined with other information that is now readily obtainable by casino management system server 114.

Gaming devices, such as gaming devices 104A-104X and 200, are highly regulated to ensure fairness and, in many cases, gaming devices 104A-104X and 200 are operable to award monetary awards (e.g., typically dispensed in the form of a redeemable voucher). Therefore, to satisfy security and regulatory requirements in a gaming environment, hardware and software architectures are implemented in gaming devices 104A-104X and 200 that differ significantly from those of general-purpose computers. Adapting general purpose computers to function as gaming devices 200 is not simple or straightforward because (1) regulatory requirements for gaming devices, (2) harsh environments in which gaming devices operate, (3) security requirements, and (4) fault tolerance requirements. These differences require substantial engineering effort and often additional hardware.

When a player wishes to play gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances of the game. The credit balance is decreased by the amount of each wager and increased upon a win. The player can add additional credits to the balance at any time. The player may also optionally insert a loyalty club card into card reader 230. During the game, the player views the game outcome on game displays 240 and 242. Other game and prize information may also be displayed.

For each game instance, a player may make selections that may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using player-input buttons 236, primary game display 240, which may include a touch screen, or using another suitable device that enables a player to input information into gaming device 200.

During certain game events, gaming device 200 may display visual and auditory effects that can be perceived by the player. These effects add to the excitement of a game, which makes a player more likely to continue playing. Auditory effects include various sounds that are projected by speakers 220. Visual effects include flashing lights, strobing lights, or other patterns displayed from lights on gaming device 200 or from lights behind information panel 152, shown in FIG. 1.

When the player wishes to stop playing, he/she cashes out the credit balance (typically by pressing a cash out button to receive a ticket from ticket printer 222). The ticket may be "cashed-in" for money or inserted into another machine to establish a credit balance for play.

Figure 3:
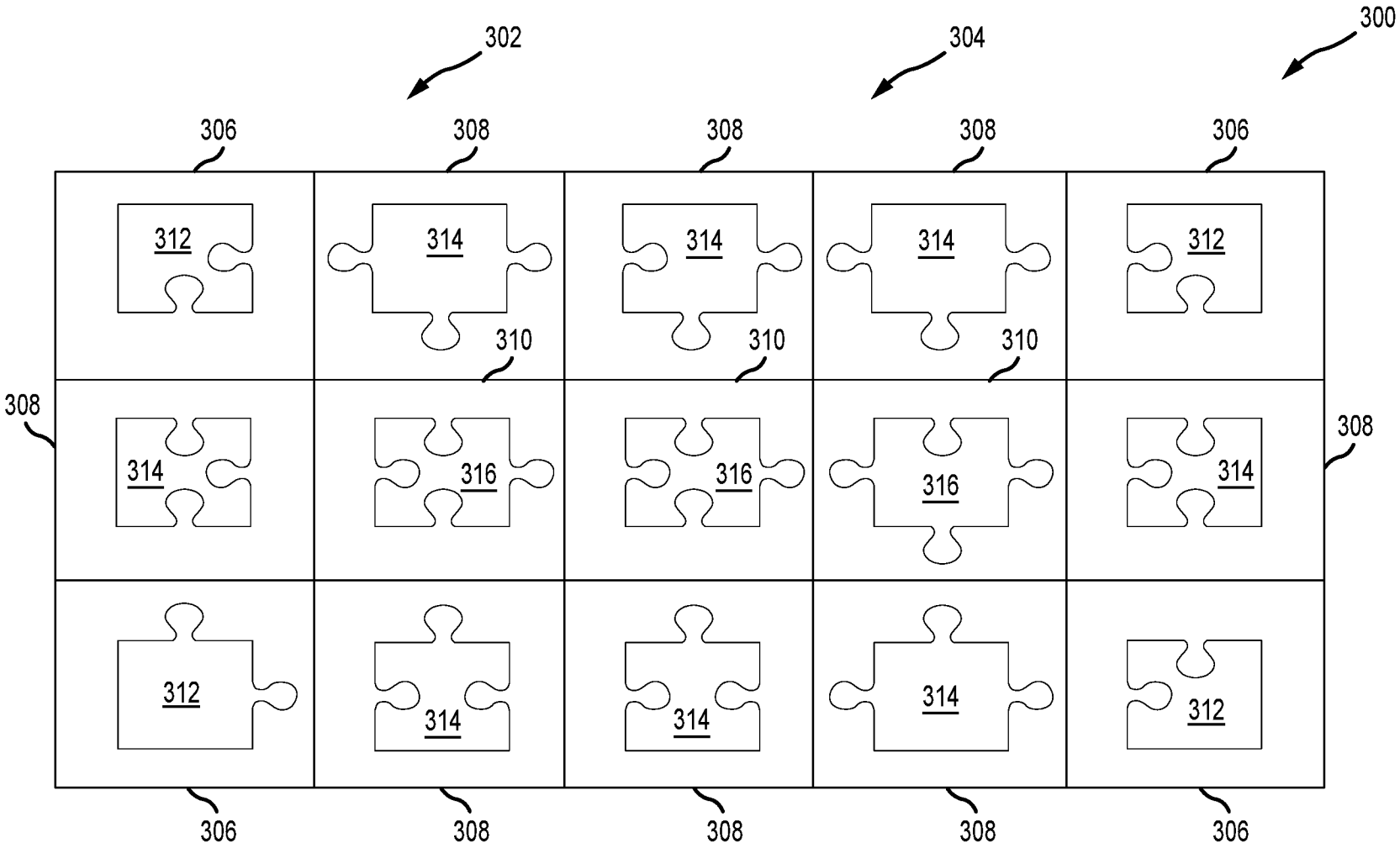
FIG. 3 is a schematic view of an exemplary wagering game that includes a plurality of reels with interlocking puzzle piece symbols.

FIG. 3 is a schematic view 300 of an exemplary wagering game that includes a plurality of reels with interlocking puzzle piece symbols 302. In the exemplary embodiment, the plurality of reels each include a plurality of positions 304. During gameplay, each position 304 includes a puzzle piece symbol 302.

The plurality of positions 304 include corner positions 306, edge positions 308, and inner positions 310. In the exemplary embodiment, corner positions 306 only displays corner symbols 312. The corner symbols 312 include at least two connectors. In this embodiment, edge symbols 314 only appear in edge positions 308 and inner symbols 316 only appear in inner positions 310. The edge symbols 314 include at least three connectors. The inner symbols 316 include at least four connectors. In other embodiments, any type of puzzle piece symbol 302 may appear in any position 304.

Each puzzle piece symbol 302 includes a plurality of connectors. In the exemplary embodiment, each puzzle piece symbol 302 is designed to be fully interlocking with puzzle piece symbols 302 with matching connectors. While traditional jigsaw puzzles include a nodule in one piece and a matching receptacle in the matching piece, any set of matching shapes may be used. Furthermore, while the disclosure herein describes using rectangular symbols, any shape of puzzle piece may be used to complete the operations described herein. In addition, any shape of puzzle may be used, such as, but not limited to, circular, triangular, and three-dimensional. Moreover, the present Figures illustrate a 3 row by 5 column grid of puzzle pieces; however, the grid of puzzle pieces may include any number of rows and columns. In some embodiments, during gameplay the game controller may add additional rows or columns to increase the size of the puzzle by, e.g., raising up the top row and adding an additional row in the middle of the puzzle. This would allow the play to have more potential combinations for potential matches.

Figure 4:
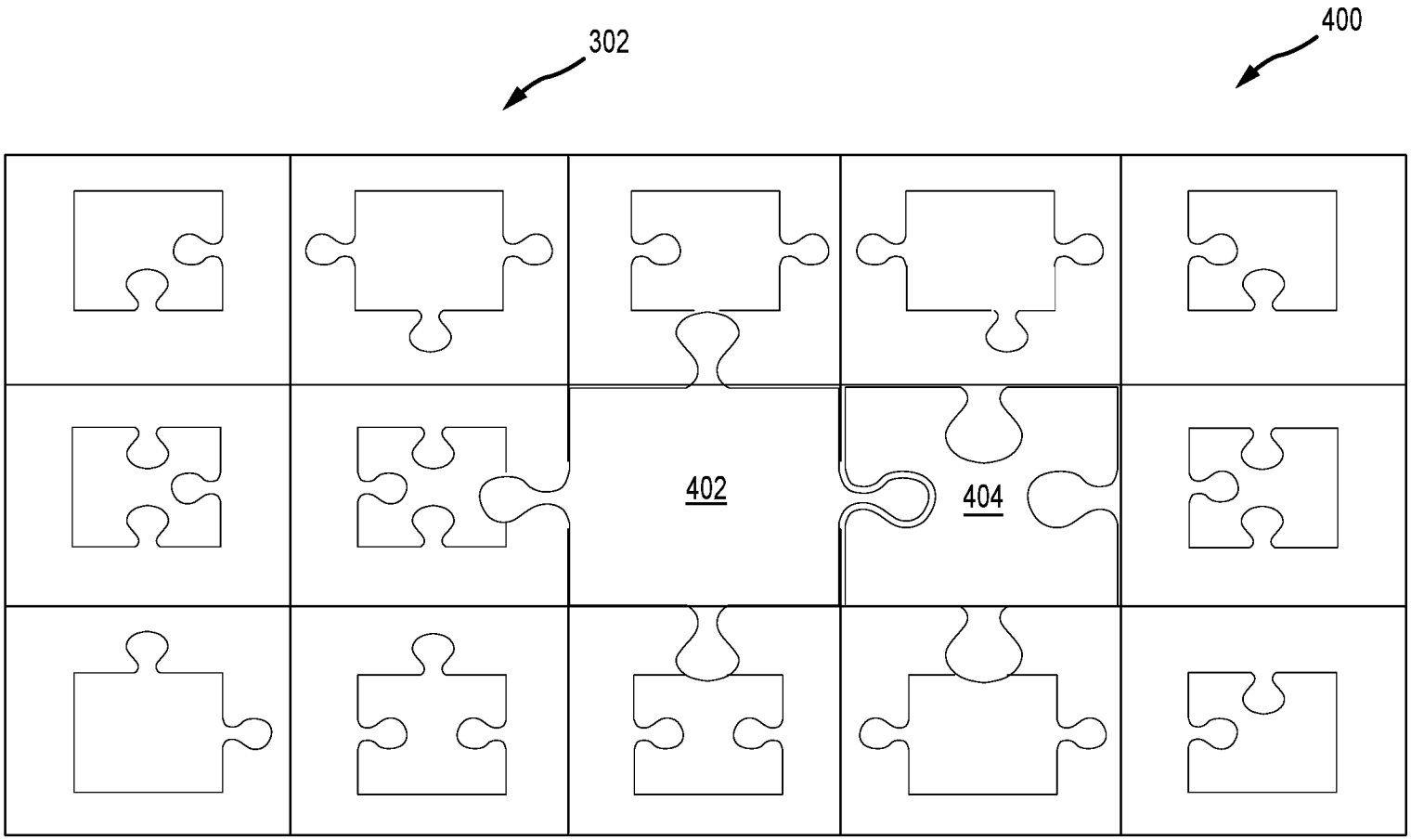
FIG. 4 is a schematic view of an exemplary waging game with a puzzle piece match on the plurality of reels shown at FIG. 3.

FIG. 4 is a schematic view 400 of an exemplary waging game with a puzzle piece match on the plurality of reels shown at FIG. 3. As shown in FIG. 4, puzzle piece symbols 402 and 404 have matching or interlocking connectors. In some embodiments, the puzzle piece symbols 302 are enlarged to show the matches or interlocks, as is illustrated in FIG. 4.

Figure 5:
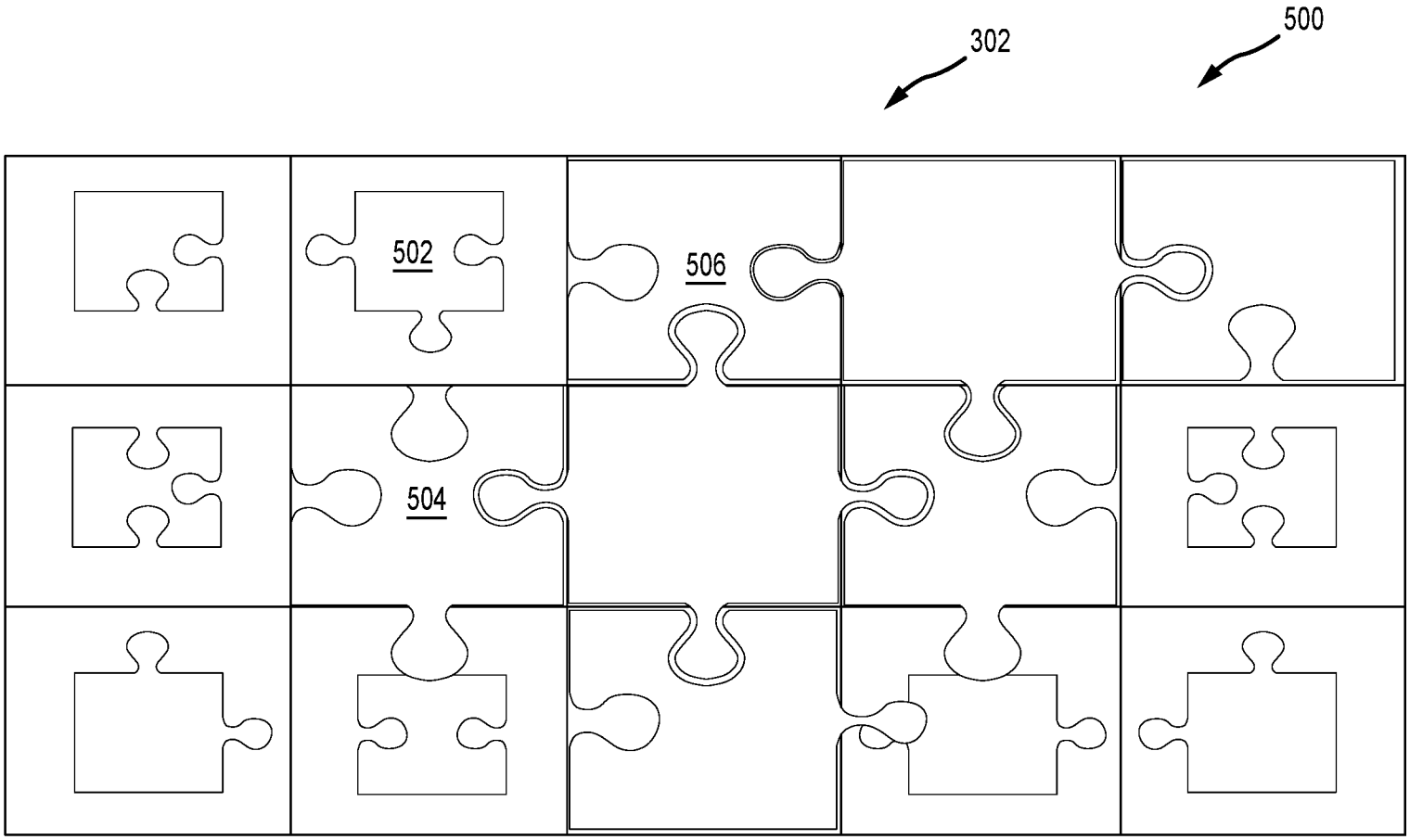
FIG. 5 is a schematic view of an exemplary waging game with multiple puzzle piece matches on the plurality of reels shown at FIG. 3.

FIG. 5 is a schematic view 500 of an exemplary waging game with multiple puzzle piece matches on the plurality of reels shown at FIG. 3. In FIG. 5, a plurality of interlocking puzzle pieces symbols 302 are shown enlarged to show the connections that have been made.

Puzzle piece symbol 502 is not enlarged, because although it does have a matching connector with puzzle piece symbol 504, the connectors between puzzle piece symbol 502 and puzzle piece symbol 506 do not match. In some embodiments, game controller 202 determines which matches to provide awards for based on the most matches. In some other embodiments, the game controller 202 would provide an award for the match between puzzle piece symbols 502 and 504. In these embodiments, game controller 202 would provide an award for each set of matching puzzle piece symbols 302, whether or not those puzzle piece symbols 302 matched any other puzzle piece symbols 302.

Figure 6:
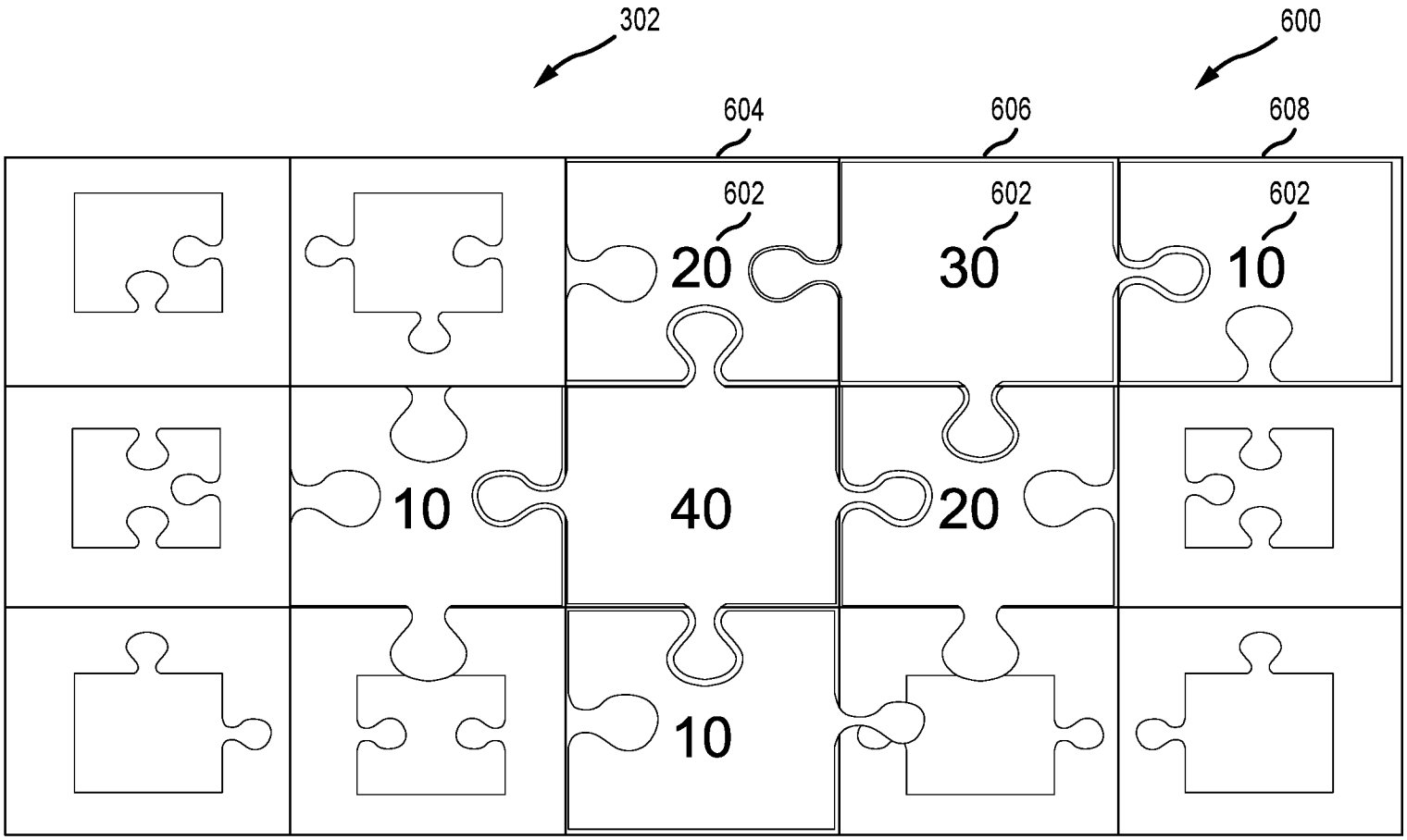
FIG. 6 is a schematic view of an exemplary waging game with multiple puzzle piece matches and award amounts on the plurality of reels shown at FIG. 3.

FIG. 6 is a schematic view 600 of an exemplary waging game with multiple puzzle piece matches and award amounts on the plurality of reels shown at FIG. 3. In this view 600, each matching puzzle piece symbol 302 also includes an award amount indicator 602. In this embodiment, the award amount is based on the number of connections made by the corresponding puzzle piece symbol 302. As shown in view 600, puzzle piece symbol 604 has made two connections and thus the corresponding award amount indicator 602 provides 20 credits (10 credits per connection made). Puzzle piece symbol 606 has three connections with other puzzle piece symbols 302 and thus its corresponding award amount indicator 602 provides 30 credits. While, puzzle piece symbol 608 only has one connection, with puzzle piece symbol 606, and thus its award amount indicator 602 lists 10 credits awarded. While FIG. 6 displays providing 10 credits per connection any other amount may be provided. Furthermore, the amounts may not be linear or even based on the number of connections made. In some embodiments, awards may be based on the individual puzzle piece symbols matched, where some puzzle piece symbols may have additional or bonus amounts associated with them.

Figure 7:
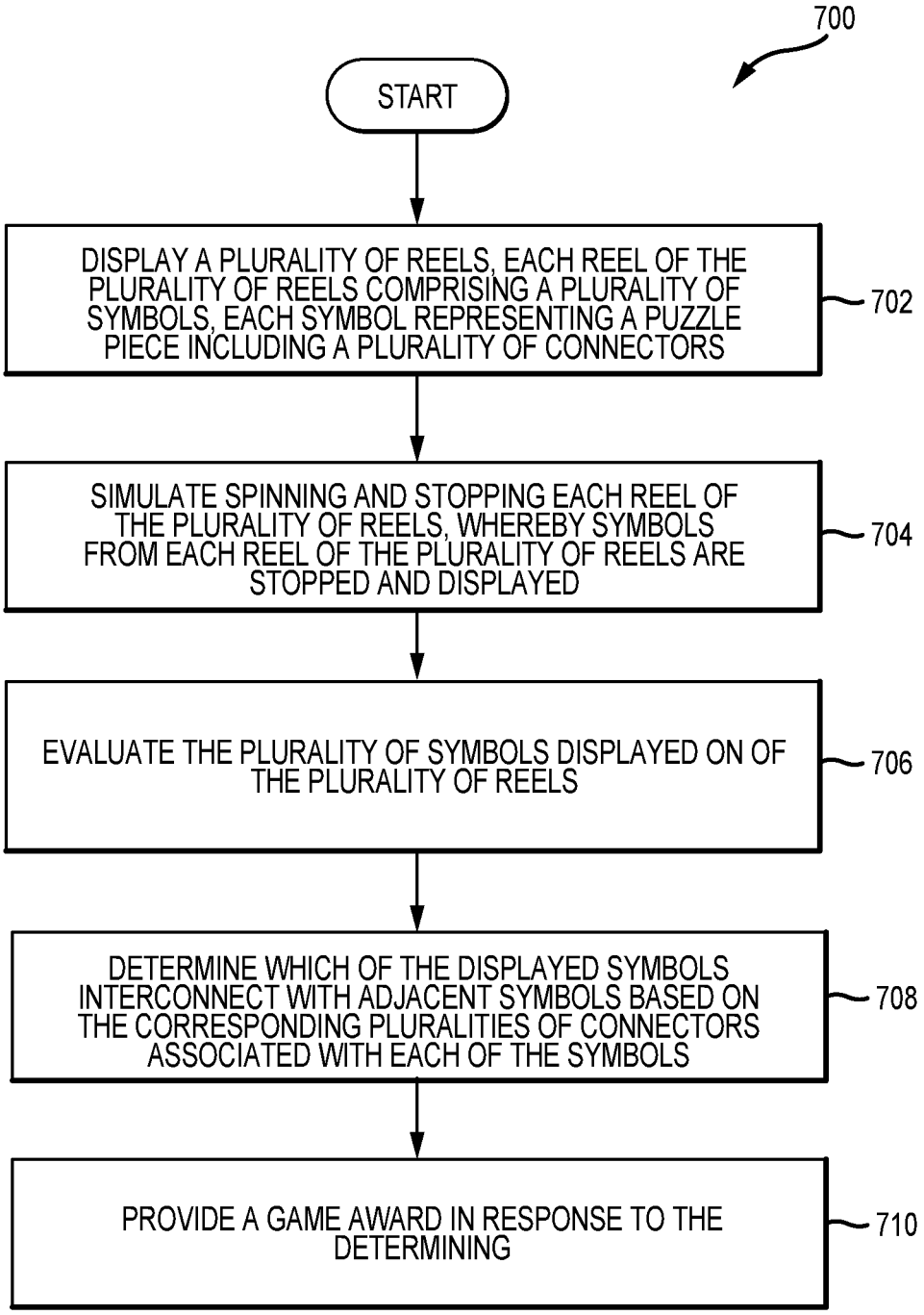
FIG. 7 is a flowchart illustrating an exemplary process for playing the wagering game that includes the plurality of reels with puzzle piece symbols described with respect to FIGS. 4-6.

FIG. 7 is a flowchart illustrating an exemplary process 700 for playing the wagering game that includes the plurality of reels with puzzle piece symbols 302 described with respect to FIGS. 3-6. In the exemplary embodiment, process 700 is performed by game controller 202 (shown in FIG. 2).

In the exemplary embodiment, game controller 202 displays 702, on a display, such as primary game display 240, a plurality of reels, each reel of the plurality of reels includes a plurality of symbols. Each symbol represents a puzzle piece including a plurality of connectors. As shown above in FIGS. 3-6, the plurality of reels include a plurality of positions 304 that each include a puzzle piece symbol 302. When the player initiates the wagering game, the game controller 202 simulates spinning and stopping 704 each reel of the plurality of reels. The puzzle piece symbols 302 from each reel of the plurality of reels are stopped and displayed. In the exemplary embodiment, game controller 202 resets the screen for each spin and simulates spinning and stopping 704 each position of each reel after providing each game award. In some embodiments, matched symbols remain on the screen during subsequent spins.

In the exemplary embodiment, game controller 202 evaluates 706 the plurality of symbols 302 displayed on the plurality of reels. Game controller 202 determines 708 which of the displayed symbols 302 match with adjacent symbols 302. In the exemplary embodiment, matching an adjacent symbol 302 includes interconnecting between adjacent connectors on adjacent symbols 302. In some embodiments, game controller 202 matches the symbols 302 based on the shapes of the corresponding connectors. In the exemplary embodiment, game controller 202 matches each pair of adjacent symbols 302 based on a first connector on a first symbol 302 of the pair of adjacent symbols interconnecting with a second connector of a second symbol 302 of the pair of adjacent symbols. The first connector faces the second symbol 302 and the second connector faces the first symbol 302, as described above in relation to FIGS. 4-6. In other embodiments, each symbol 302 is also colored and game controller 202 determines the match based on the shape and the colors of the adjacent symbols. For example, two puzzle piece symbols 302 may have interconnecting shapes, but be different colors. In this example, game controller 202 may determine that these symbols 302 do not match. In some embodiments, game controller 202 may award the player for a partial match if the shapes match, but not the colors.

Based on the determining, game controller 202 provides 710 a game award. In some embodiments, the game award is based on a number of connected (matching adjacent) symbols, a number of connections per symbol, a value of credits shown on each connected symbol (WYSIWYG), a value of credits shown on each connected symbol times a number of connections multiplier, an award for percentage of completion of puzzle picture, a value of award (per any of the above) times a multiplier shown on a connected symbol. In some embodiments, one or more What You See Is What You Get (WYSIWYG) symbols may appear on puzzle piece symbols 302. WYSIWYG symbol values may be a number of credits, an award multiplier, a static bonus award, a progressive tier award, a number of free spins (which may trigger a free spin bonus), and a mystery symbol which when revealed becomes any of the previous examples.

Progressives may be awarded based on a set of symbols connected. As an example if the upper left two symbols connect to display 'MINI' the mini progressive is awarded, or if the four lower right symbols connect to display 'MAX' the max progressive is awarded, or if all symbols in the middle three rows are connected to display 'GRAND' the grand progressive is awarded. In some embodiments, the number of matches may trigger a bonus game as described in FIG. 8.

In some embodiments, a puzzle piece symbol 302 is a "wild" symbol. In these embodiments, the "wild" symbol may transform to match one or more of the adjacent puzzle piece symbols 302. For example, after a reel spin the "wild" symbol may appear in an inner position 310. The game controller 202 displays an animation of the "wild" symbol morphing or transitioning into a puzzle piece symbol 302 that has connectors that match the four puzzle piece symbols that are adjacent. In some embodiments, the animation shows a pair of scissors cutting the "wild" symbol to fit or a first pounding the "wild" puzzle piece into place. The "wild" symbol may be triggered randomly, upon completion of a bonus game, or as a reward for a certain number of matches.

Figure 8:
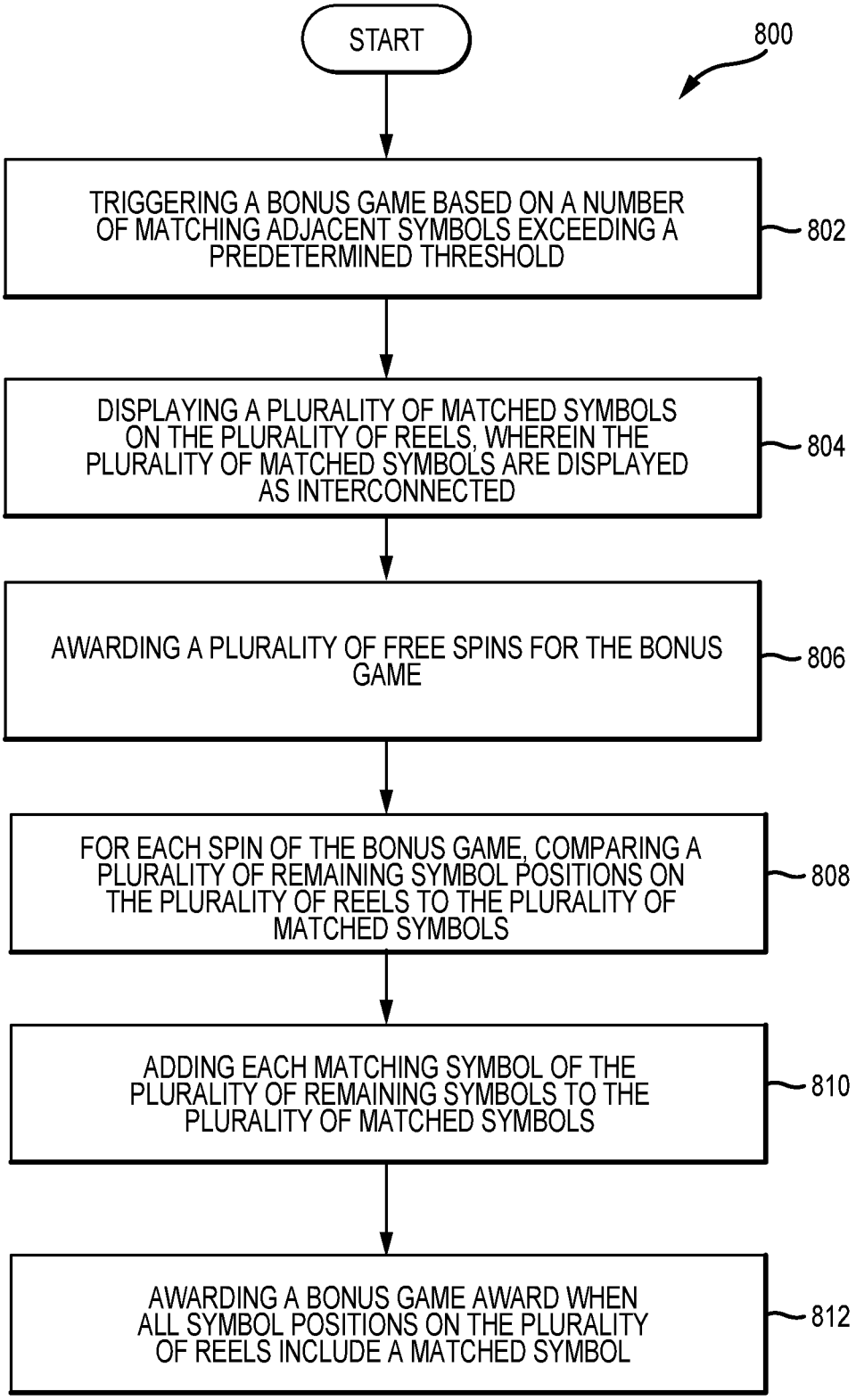
FIG. 8 is a flowchart illustrating an exemplary process for playing a bonus game based on the wagering game as described with respect to FIG. 7.

FIG. 8 is a flowchart illustrating an exemplary process 800 for playing a bonus game based on the wagering game as described with respect to FIG. 7. In the exemplary embodiment, process 800 is performed by game controller 202 (shown in FIG. 2).

In the exemplary embodiment, game controller 202 triggers 802 a bonus game based on a number of matching adjacent symbols exceeding a predetermined threshold. For example, the predetermined threshold number may be six. In this example, the number of matching symbols in view 500 (shown in FIG. 5) would trigger the bonus game. In other embodiments, the bonus game may be triggered 802 by a specific symbol appearing or any other trigger e.g. a random trigger. Game controller 202 displays 804 the plurality of matched symbols on the plurality of reels. The plurality of matched symbols are displayed 804 as interconnected, such as shown in FIG. 5. As part of the bonus game, game controller 202 awards 806 a plurality of free spins for the bonus game. In some embodiments the number of respins corresponds to the number of triggering matching symbols, e.g. six matching triggering symbols awards five respins, seven matching triggering symbols awards nine respins, etc.

During a free spin, game controller 202 keeps the connected symbols, such as 504 and 506, on the display, while unconnected symbols, such as 502 are spun to change the symbols in those positions 304.

After a spin in the bonus game is completed, game controller 202 compares 808 the plurality of remaining symbol positions on the plurality of reels to the plurality of matched symbols. If there is a matching symbol, the matching symbol is added 810 to the plurality of matched symbols and kept on the display during the remaining spins. In addition, game controller 202 provides a game award based on the new matches. In some embodiments, this is a different game award than that award for a match in the base game. In some embodiments, when a match is made, game controller 202 awards additional bonus spins.

When all of the symbol positions 304 displays matched symbols 302, game controller 202 awards 812 a bonus game award. The puzzle is complete with all of the symbols 302 have matches for all of their connectors. In some embodiments, when the puzzle is complete, game controller 202 instructs the display to rotate, reverse, or 'flip over' the plurality of matched symbols to display an image. In some embodiments, this image may be any image of a scene or item that the complete puzzle shows. In some embodiments, the image may be a composite image, where different puzzle pieces may be from different puzzles and associated with different images. For example, the final image may be an animal with a lion's body and a dragon's head, where the puzzle pieces that made up the image were from different puzzles based off of those two images. In some further embodiments, game controller 202 awards a bonus game award based on the displayed image. For example, if the image is a complete lion, then the additional game award may be different than if the image is a dragon. Or the award may be based on how compete or homogeneous the image is. In some embodiments, the image may be related to another, superior or larger, game award, such as a "MINOR," "MAJOR," or "GRAND" game award.

In some embodiments, game controller 202 limits the matches based on the color of the individual puzzle piece symbols 302. In these embodiments, game controller 202 only matches the piece symbols 302 when the shapes and the colors match. In other embodiments, game controller 202 matches the symbols 302 based on the shape, such that two different colored pieces may be matched. In some further embodiments, game controller 302 only allows color-independent matches during the bonus game. In these embodiments, the different colored piece symbols 302 are from different puzzles. For example, red piece symbols 302 may be from the lion image, while blue piece symbols 302 are from the dragon image.

In some embodiments, the bonus game is triggered when a predetermined threshold number of matches of the same color is met. For example, if the threshold is six matches, and there are four blue matches and two red matches, the bonus game doesn't trigger. If there are seven red matches and two blue, then the bonus game triggers. In this example, the seven red matches are kept and the rest of the screen, including the two blue matches are re-spun.

Thus, a wagering game is provided. The wagering game may include one or more sets of reels. In the exemplary embodiment, each reel includes a plurality of positions where symbols may be placed. Each symbol resembles a puzzle piece (such as a jigsaw puzzle piece). The reels may be spun and stopped, and the plurality of symbols from each of the reels may be displayed. The symbols from each reel may be evaluated to determine whether adjacent symbols are puzzle pieces that may fit together or interlock. The player is rewarded based on how the puzzle pieces fit together, how many puzzle pieces have connections, and/or how many connections are made for each puzzle piece. In some embodiments, if a predetermined number of pieces make matches, a bonus game is initiated. The bonus game keeps the matched pieces/symbols and provides a number of free spins for the player to make additional matches. In some further embodiments, if all of the symbols are matched the puzzle changes orientation to reveal an image. In other words, if and when the puzzle pieces complete an entire puzzle, the puzzle pieces flip over to reveal an image on the other side that is formed by the puzzle pieces. The exposed image may relate to an additional award to the player.

A computer, controller, or server, such as those described herein, includes at least one processor or processing unit and a system memory. The computer, controller, or server typically has at least some form of computer readable non-transitory media. As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits "configured to" carry out programmable instructions, and these terms are used interchangeably herein. In the embodiments described herein, memory may include, but is not limited to, a computer-readable medium or computer storage media, volatile and nonvolatile media, removable and non-removable media implemented in any method or technology for storage of information such as computer readable instructions, data structures, program modules, or other data. Such memory includes a random access memory (RAM), computer storage media, communication media, and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

As indicated above, the process may be embodied in computer software. The computer software could be supplied in a number of ways, for example on a tangible, non-transitory, computer readable storage medium, such as on any nonvolatile memory device (e.g. an EEPROM). Further, different parts of the computer software can be executed by different devices, such as, for example, in a client-server relationship. Persons skilled in the art will appreciate that computer software provides a series of instructions executable by the processor.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. An electronic gaming machine comprising:

an electronic display;

an input interface configured to receive a player input; and a game controller configured to execute instructions stored in a tangible, non-transitory, computer-readable storage medium, which, when executed by the game controller cause the game controller to at least:

receive the player input from the input interface;

display, on the electronic display, a plurality of reels, each reel of the plurality of reels comprising a plurality of symbols, each symbol representing a puzzle piece including a plurality of connectors, wherein the connectors each comprise a nodule or a receptacle;

display, on the electronic display, a plurality of positions within the plurality of reels, wherein each of the positions includes a symbol of the plurality of symbols, wherein the plurality of positions includes a plurality of edge positions and a plurality of inner positions;

display, on the electronic display, edge symbols in the plurality of edge positions, wherein the edge symbols include at least three connectors;

display, on the electronic display, inner symbols in the plurality of inner positions, wherein the inner symbols include at least four connectors;

simulate spinning and stopping each reel of the plurality of reels, whereby symbols from each reel of the plurality of reels are stopped and displayed on the electronic display;

identify each connector of the symbols displayed at the plurality of edge positions and the plurality of inner positions;

analyze each identified connector with a respective adjacent connector, wherein each identified connector and respective adjacent connector comprises a connector pair of a plurality of connector pairs;

determine which of the plurality of connector pairs comprises a match between a nodule and a receptacle;

determine adjacent symbols associated with each determined match; and display, on the electronic display, interconnecting of the adjacent symbols associated with each determined match, wherein the interconnecting includes causing the adjacent symbols associated with each match to expand to interconnect with one another on the electronic display.

2. The electronic gaming machine of claim 1, wherein, when executed, the instructions further cause the game controller to at least display on the electronic display a game award based on a number of interconnected adjacent symbols.

3. The electronic gaming machine of claim 1, wherein, when executed, the instructions further cause the game controller to at least match a pair of adjacent symbols based on a first connector on a first symbol of the pair interconnecting with a second connector of a second symbol of the pair, wherein the first connector faces the second symbol and the second connector faces the first symbol.

4. The electronic gaming machine of claim 1, wherein, when executed, the instructions further cause the game controller to at least match a pair of the displayed symbols based on shape and color.

5. The electronic gaming machine of claim 1, wherein the plurality of positions further include a plurality of corner positions, wherein, when executed, the instructions further cause the game controller to at least display corner symbols in the plurality of the corner positions, wherein the corner symbols include at least two connectors.

6. The electronic gaming machine of claim 1, wherein, when executed, the instructions further cause the game controller to at least simulate spinning and stopping each of the plurality of the positions of each reel after providing a game award, wherein each symbol of the plurality of symbols is randomly determined based on a corresponding position.

7. The electronic gaming machine of claim 1, wherein, when executed, the instructions further cause the game controller to at least:

trigger a bonus game based on a number of interconnected adjacent symbols exceeding a predetermined threshold;

display, on the electronic display, a plurality of matched symbols on the plurality of reels, wherein the plurality of matched symbols are displayed as being interconnected; and award a plurality of free spins for the bonus game.

8. The electronic gaming machine of claim 7, wherein, when executed, the instructions further cause the game controller to at least:

for each spin of the bonus game, compare a plurality of remaining ones of the positions on the plurality of reels to the plurality of matched symbols; and add each matching symbol of the plurality of remaining ones of the positions to the plurality of matched symbols.

9. The electronic gaming machine of claim 8, wherein, when executed, the instructions further cause the game controller to at least:

award a bonus game award when all of the positions on the plurality of reels include a matched symbol.

10. The electronic gaming machine of claim 8, wherein, when executed, the instructions further cause the game controller to at least simulate rotating the plurality of symbols to display an image when all of the positions on the plurality of reels include a symbol that is matched based on all of the plurality of connectors of the plurality of the symbols.

11. The electronic gaming machine of claim 10, wherein, when executed, the instructions further cause the game controller to at least award a bonus game award based on the displayed image.

12. The electronic gaming machine of claim 1, wherein, when executed, the instructions further cause the game controller to at least:

determine an output amount based upon a number of connections made by at least one enlarged, interconnected adjacent symbol; and display, on the electronic display, on the at least one enlarged, interconnected adjacent symbol, the output amount.

13. The electronic gaming machine of claim 1, wherein, when executed, the instructions further cause the game controller to at least display an animation of at least one symbol of the plurality of symbols transforming into a symbol that connects with at least one symbol adjacent the at least one symbol.

14. A method of electronic gaming implemented on an electronic gaming machine, the electronic gaming machine comprising an electronic display configured to present the electronic game, an input interface, and a game controller, the method comprising causing the game controller to at least:

receive an input from the input interface;

display on the electronic display, a plurality of reels, each reel of the plurality of reels comprising a plurality of symbols, each symbol representing a puzzle piece including a plurality of connectors, wherein the connectors each comprise a nodule or a receptacle;

display on the electronic display, a plurality of positions within the plurality of reels, wherein each of the positions displays a symbol of the plurality of symbols, wherein the plurality of positions includes a plurality of corner positions, a plurality of edge positions, and a plurality of inner positions;

display on the electronic display, corner symbols in the plurality of corner positions, wherein the corner symbols include at least two connectors;

display on the electronic display, edge symbols in the plurality of edge positions, wherein the edge symbols include at least three connectors;

display on the electronic display, inner symbols in the plurality of inner positions, wherein the edge symbols include at least four connectors;

simulate spinning and stopping each reel of the plurality of reels, whereby symbols from each reel of the plurality of reels are stopped and displayed on the electronic display;

identify each connector of the symbols displayed at the plurality of edge positions and the plurality of inner positions;

analyze each identified connector with a respective one or more adjacent connector, wherein each identified connector and respective one or more adjacent connector comprises a connector pair of a plurality of connector pairs;

determine which of the plurality of connector pairs comprises a match between a nodule and a receptacle;

determine adjacent symbols associated with each determined match; and display, on the electronic display, interconnecting of the adjacent symbols associated with each determined match, wherein the interconnecting includes causing the adjacent symbols associated with each match to expand to interconnect with one another on the electronic display.

15. The method of claim 14, further comprising providing a game award based on a number of interconnected adjacent symbols.

16. The method of claim 14, further comprising matching a pair of symbols based on shape and color.

17. The method of claim 14, further comprising simulating spinning and stopping each of the positions of each reel after providing a game award, wherein each symbol of the plurality of symbols is randomly determined based on a corresponding position.

18. The method of claim 14, further comprising:

triggering a bonus game based on a number of interconnected adjacent symbols exceeding a predetermined threshold;

displaying a plurality of matched symbols on the plurality of reels, wherein the plurality of matched symbols are displayed as being interconnected;

awarding a plurality of free spins for the bonus game;

for each spin of the bonus game, comparing a plurality of remaining ones of the positions on the plurality of reels to the plurality of matched symbols;

adding each matching symbol of the plurality of remaining ones of the positions to the plurality of matched symbols; and awarding a bonus game award when all of the positions on the plurality of reels include a matched symbol.

19. The method of claim 18, further comprising:

simulating rotating the plurality of symbols to display an image when all of the positions on the plurality of reels include a symbol that is matched based on all of the plurality of connectors of the plurality of symbols; and awarding a bonus game award based on the displayed image.

20. A computer-readable storage medium having computer-executable instructions embodied thereon, which when executed by a game controller of an electronic gaming machine, cause the game controller to at least:

receive an input from an input device;

display, on an electronic display, a plurality of reels, each reel of the plurality of reels comprising a plurality of symbols, each symbol representing a puzzle piece including a plurality of connectors, wherein the connectors each comprise a nodule or a receptacle;

display, on the electronic display, a plurality of positions within the plurality of reels, wherein each of the positions includes a symbol of the plurality of symbols, wherein the plurality of positions includes a plurality of edge positions and a plurality of inner positions;

display, on the electronic display, edge symbols in the plurality of edge positions, wherein the edge symbols include at least three connectors;

display, on the electronic display, inner symbols in the plurality of inner positions, wherein the inner symbols include at least four connectors;

simulate spinning and stopping each reel of the plurality of reels, whereby symbols from each reel of the plurality of reels are stopped and displayed;

identify each connector of the symbols displayed at the plurality of edge positions and the plurality of inner positions;

analyze each identified connector with a respective one or more adjacent connector, wherein each identified connector and respective one or more adjacent connector comprises a connector pair of a plurality of connector pairs;

determine which of the plurality of connector pairs comprises a match between a nodule and a receptacle;

determine adjacent symbols associated with each determined match; and display, on the electronic display, interconnecting of the adjacent symbols associated with each determined match, wherein the interconnecting includes causing the adjacent symbols associated with each match to expand to interconnect with one another on the electronic display.

* * * * *